United States Patent [19]

Carter

[11] 4,427,330

[45] Jan. 24, 1984

[54] AUTOMATIC FENCE PICKET STOCK CONVEYOR FOR FENCE PICKET POINTING MACHINE

[76] Inventor: Charles P. Carter, 301 SW. 46, Oklahoma City, Okla. 73109

[21] Appl. No.: 310,024

[22] Filed: Oct. 13, 1981

Related U.S. Application Data

[63] Continuation-in-part of Ser. No. 239,965, Mar. 3, 1981, Pat. No. 4,387,751.

[51] Int. Cl.[3] ..... B65G 59/02

[52] U.S. Cl. ..... 414/113; 144/245 F; 414/118; 414/124

[58] Field of Search ..... 414/112, 113, 114, 117, 414/118, 119, 120, 124; 271/10; 144/245 A, 245 F

[56] References Cited

U.S. PATENT DOCUMENTS 3,719,216 3/1973 Tracy ..... 144/30 X

FOREIGN PATENT DOCUMENTS 38432 10/1981 European Pat. Off. ..... 414/114
2433128 1/1976 Fed. Rep. of Germany ..... 414/114
128230 5/1950 Sweden ..... 414/118

*Primary Examiner*—Leslie J. Paperner
*Attorney, Agent, or Firm*—Robert K. Rhea

[57] ABSTRACT

An upright fence picket workpiece bundle receiving frame is disposed in lateral parallel relation with respect to an upright elongated fence picket pointing machine and connected thereto by a horizontal frame extending between the upper limits of the bundle frame and picket pointing machine. The bundle frame includes a motor operated platform receiving and elevating a horizontal layered bundle of fence picket workpieces with the workpieces parallel with the length of the picket pointing machine. Workpiece layer operated cams and lifters, mounted on the bundle frame, aligns respective end portions of the uppermost layer of the workpiece bundle and lifts the topmost layer thereof to a horizontal plane spaced above the remaining workpiece bundle and the horizontal frame. Motor operated drag chains, overlying the horizontal frame and projecting into the workpiece bundle frame, move the lifted workpiece layer to an overlying position on the horizontal frame. The horizontal frame includes a stationary portion and a reciprocating portion moved to and fro between the bundle frame and picket pointing machine which, in its movement toward the picket pointing machine, lifts the overlying workpiece layer with respect to the stationary frame portion and deposits the workpieces, one at a time, to fall horizontally by gravity into the picket pointing machine.

10 Claims, 19 Drawing Figures

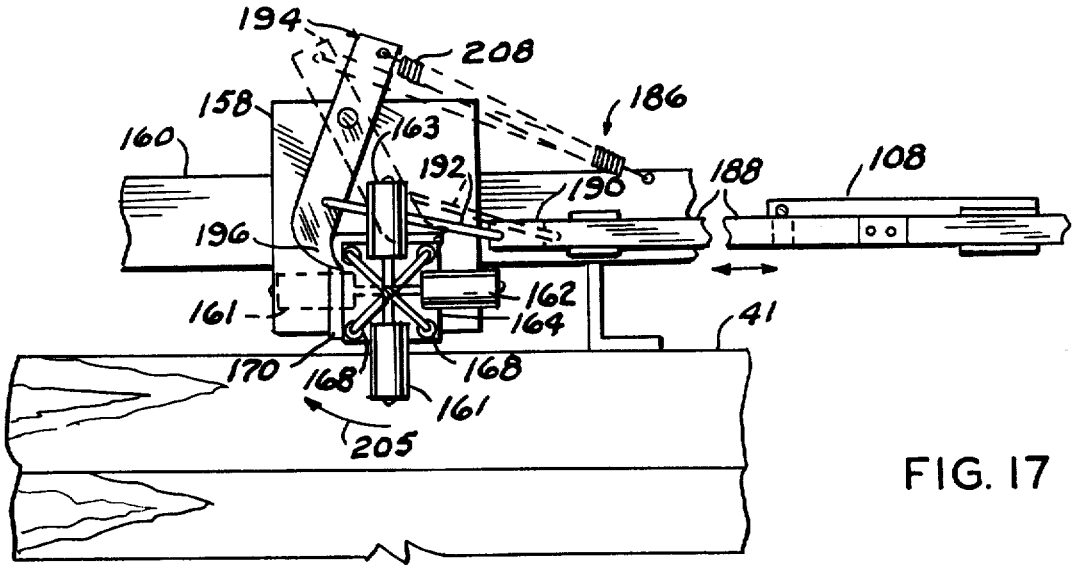
FIG. 17
FIG. 18
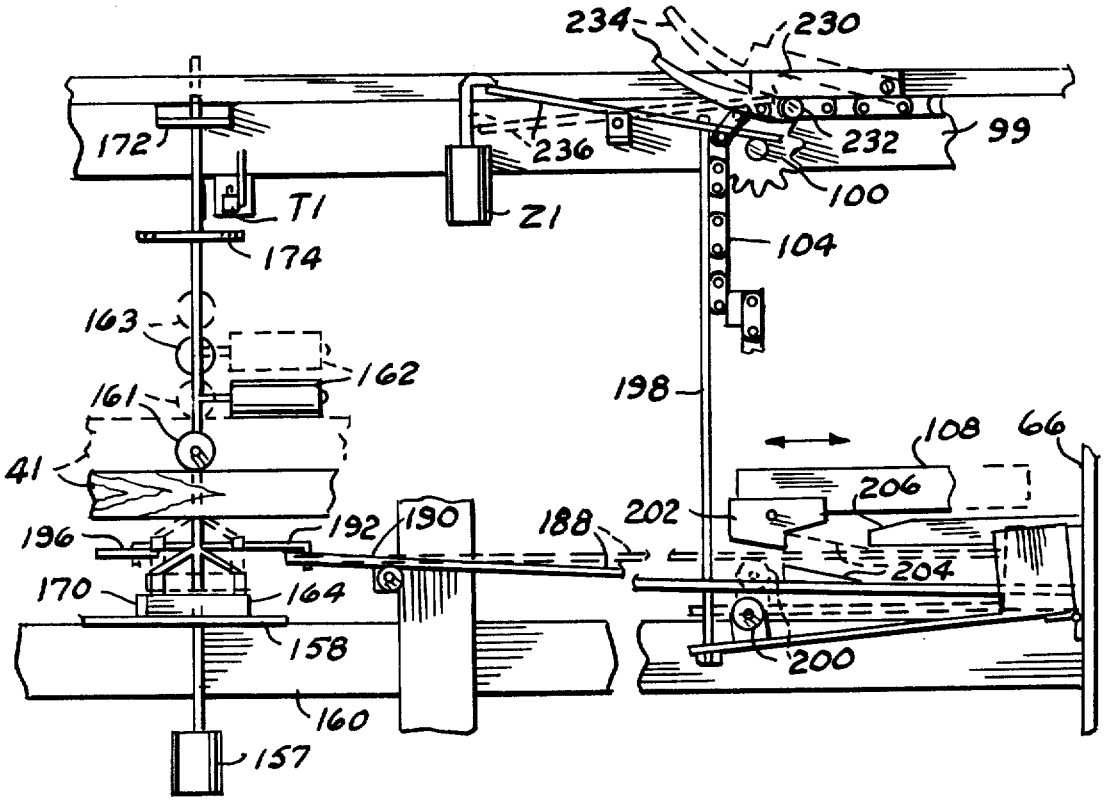

AUTOMATIC FENCE PICKET STOCK CONVEYOR FOR FENCE PICKET POINTING MACHINE

CROSS REFERENCE TO RELATED APPLICATION

This application is a continuation-in-part of an application filed by me in the United States Patent and Trademark Office on Mar. 3, 1981, Ser. No. 239,965 for Automatic Fence Picket Pointing Machine, now U.S. Pat. No. 4,387,751.

BACKGROUND OF THE INVENTION

1. Field of the Invention

The present invention relates to conveyors and more particularly to a conveyor for automatically feeding fence picket stock by gravity into the upwardly open throat of an elongated fence picket pointing machine.

For continuous operation of the above named fence picket pointing machine it is necessary that the picket stock be sequentially fed into the picket pointing machine in sequence with the operation thereof.

This invention provides a conveyor which automatically picks up, in sequence, horizontal layers of picket stock and feeds the picket stock by gravity, one at a time, into the fence picket pointing machine from a bundle of picket stock deposited within the confines of the conveyor.

2. Description of the Prior Art

Prior patents generally disclose a hopper or a platform receiving a plurality of picket fence forming members manually placed in the hopper or stacked on the platform forming a part of or adjacent a fence picket pointing machine in which the picket forming members are sequentially moved into position for processing by the picket pointing machine.

This invention is distinctive over prior art patents by providing a conveyor which receives a multilayered bundle of picket stock and lifts the horizontal layers of picket stock, as units, in sequence from the bundle and deposits them on a horizontal platform having a reciprocating portion moving the picket stock layer toward and into the picket pointing machine in sequence with the operation thereof,

SUMMARY OF THE INVENTION

The conveyor comprises an upright open framework, including a rectangular bundle frame, disposed laterally of a picket pointing machine which receives, in surrounding relation, a rectangular bundle of horizontal layers of picket stock with the longitudinal length of the picket stock disposed parallel with the longitudinal axis of the picket pointing machine. Each layer of picket stock is formed by a plurality of fence picket forming members. A motor driven platform lifts the picket bundle to dispose the upper layer thereof adjacent the depending limit of picket stock layer lifting members disposed at respective ends of the bundle frame which elevates the uppermost layer of the picket stock above the remaining layers of the bundle.

The bundle frame is connected to the adjacent side of the picket pointing machine by a horizontal open framework which horizontally supports at least one layer of the picket stock. The horizontal framework includes a reciprocating frame actuated by and in sequence with the operation of the picket pointing machine for reciprocation between the picket pointing machine and bundle frame which lifts the overlaying layer of picket stock for depositing the picket stock members, one at a time, with each reciprocating action, into the throat of the picket pointing machine. A pair of opposing tilt shelves spaced above the horizontal frame underlie and support the respective end portions of a subsequent horizontal layer of the picket stock which is released by a camming action to fall by gravity on the horizontal frame at a predetermined time. Another picked up layer of picket stock, lifted and supported by the picket frame lifting members, is moved to and supported by the tilt shelves by a pair of drag chains actuated by the tilt shelves returning to picket layer supporting position.

The principal objects of this invention are to provide an automatic feed of picket stock to a fence picket pointing machine which receives and elevates a horizontal layered bundle of picket stock, aligns the end surfaces of the uppermost layers of the picket stock, elevates the top layer of the picket stock for alignment with picket stock receiving tilt shelves, moves the picked up layer to the tilt shelves, releases the picket stock layer to a horizontal platform having a horizontally reciprocating portion for lifting the picket stock layer and moving it laterally toward the picket pointing machine to fall horizontally edgewise by gravity into the picket pointing machine in sequence with the operation thereof.

BRIEF DESCRIPTION OF THE DRAWINGS

FIGS. 7 to 10 inclusive are solid and dotted line mechanical diagrams respectively illustrating cam members connected with and sequentially operating the bundle top layer lifting members, in which FIG. 7 illustrates pusher arms aligning the respective ends of the uppermost picket stock bundle layers; FIG. 8 illustrates a first lift bar moving the topmost layer as a unit to project beyond the opposite end of the bundle; FIG. 9 illustrates a second lift bar lifting the projecting end of the layer to a selected elevation while simultaneously moving the layer toward the first lift bar; and, FIG. 10 illustrates the first lift bar elevating the adjacent end portion of the layer to the horizontal plane of its first lifted end;

FIG. 17 is a fragmentary top view looking in the direction of the arrows 17—17 of FIG. 15;

FIG. 18 is an elevational view of the latch mechanism for angularly rotating the pusher bar actuator; and, FIG. 19 is a wiring diagram.

DESCRIPTION OF THE PREFERRED EMBODIMENT

Figure 1:
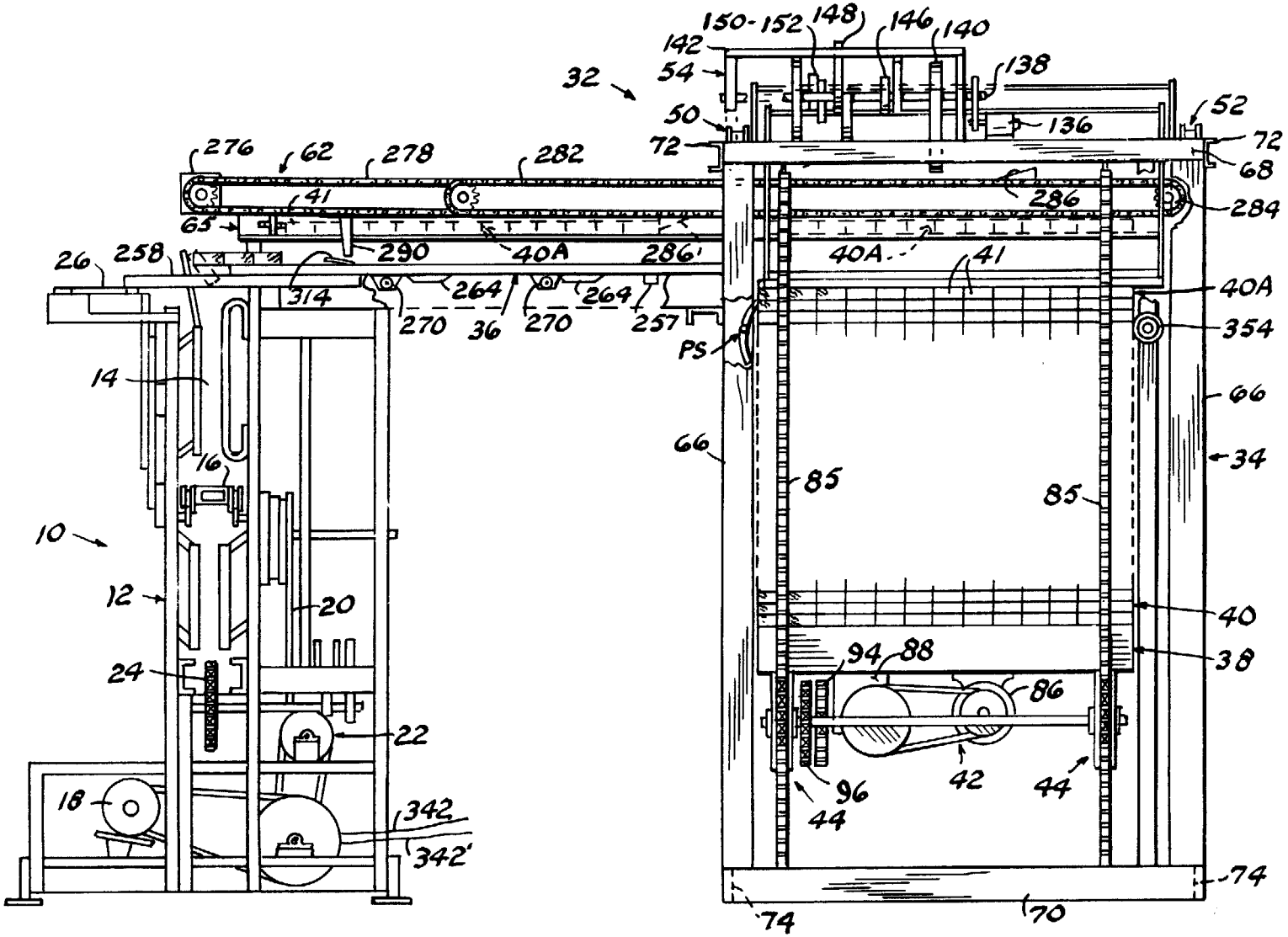
FIG. 1 is an end elevational view of the conveyor partially overlying and connected with a fence picket pointing machine with some parts broken away or omitted for clarity.

Like characters of reference designate like parts in those figures of the drawings in which they occur.

In the drawings

The reference numeral 10 indicates a picket pointing machine formed by an elongated upstanding frame 12 having an elongated upwardly open opening or throat 14 receiving horizontally disposed picket stock members falling therein by gravity. The respective end portions of each length of the respective picket stock member is received and gripped by longitudinally spaced track supported carriage means 16 driven by a motor 18 operating a pitman 20 by a belt and pulley means 22 for horizontally moving the picket stock into contact with cutters, not shown, for pointing one end thereof. The pointed picket stock is then released to fall by gravity on a pointing machine conveyor 24 moving the picket stock out of the frame 12. It is with such a picket pointing machine that the present invention is intended to be used.

At one of its sides and adjacent its upper limit, the picket pointing machine 10 horizontally supports in longitudinally spaced relation a pair of bell crank members 26 which are interconnected by a rod 28, or the like, for movement of the bell cranks in unison by an arm 30 extending between the rod 28 and the reciprocating carriage 16. The bell cranks are connected with the conveyor 32 in the manner presently explained.

The conveyer 32 comprises a rectangular upright picket stock bundle frame means 34 joined to the picket pointing machine 10 by a horizontal frame means 36.

Figure 15:
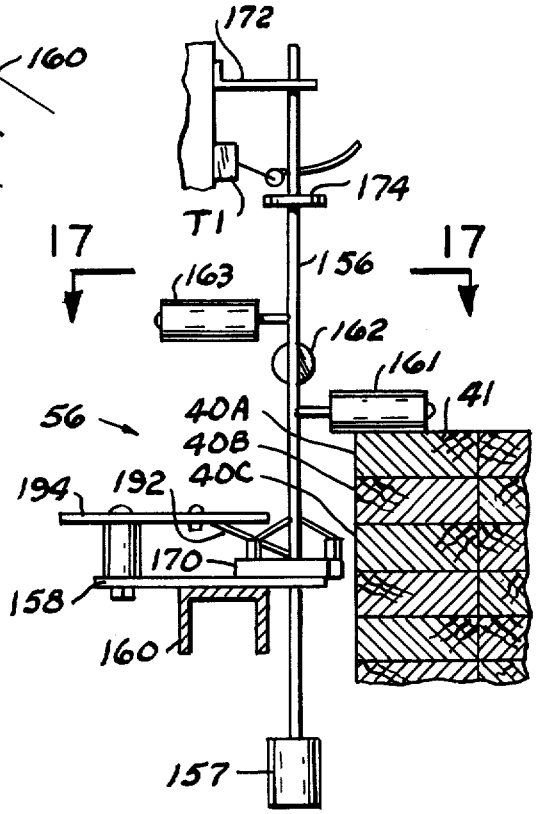
FIG. 15 is a vertical cross sectional view, to a different scale, taken substantially along the line 15—15 of FIG. 2.

The bundle frame means 34 includes a horizontal platform means 38 receiving and supporting a bundle of picket fence stock 40 formed by a plurality of picket stock members 41. The fence picket stock bundle 40 is characterized by superposed horizontal layers of 2×4 or 2×6 lumber of equal length which may be from four to eight feet, as desired. All stock of each bundle being of equal dimensions. The platform means 38 is vertically movable by motor means 42 driving a plurality of chain and sprocket means 44 for disposing the uppermost limit of the picket stock bundle 40 at a predetermined elevation. Two pairs of picket stock layer lifting means 46–48 and 50–52 (FIG. 4) are disposed at respective end portions of the bundle frame means 34 adjacent its upper limit. The pairs of bundle lifting means 46–52 are initially operated by cam means 54 (FIG. 4) in response to upward movement of the picket stock bundle 40 actuating cam trigger means 56 (FIG. 15).

The horizontal frame means 36 includes a stationary frame means 58, supporting one layer of picket stock when deposited thereon, and a reciprocating frame means 60 moved by the pair of bell cranks 26 for moving the overlying layer of picket stock laterally toward the throat 14 of the picket pointing machine 10. The frame means 36 further includes drag chain drive means 62 moving a subsequent layer of picket stock from the layer lifting means 46–52 to a superposed position above the stationary frame means 58 on a pair of layer storage means 64 and 65 for release of the stored layer of picket stock to the stationary frame means 58 in sequence with feeding the preceeding layer of fence picket stock into the picket pointing machine.

BUNDLE FRAME MEANS

The bundle frame means 34 is formed by four upright corner posts 66 interconnected at their upper and lower limits by end cross members 68 and 70 and at respective sides of the frame means by upper and lower members 72 and 74 (FIG. 1) thus forming an open frame having its side, opposite the picket pointing machine 10, open. The platform means 38 is of conventional construction formed by a pair of spaced-apart elongated supports 76 extending longitudinally between the ends of the frame means 34 and supporting intermediate their ends a horizontal platform 78. The platform 78 supports the picket bundle 40 when disposed thereon with the picket stock members extending longitudinally of the bundle frame. The picket stock overlies and closes a microswitch C1 in the circuit to the picket pointing machine motor 18, as presently explained.

The chain and sprocket means 44 is secured to the respective end portions of the supports 76 and comprises a driven sprocket 80 mounted on the respective end portions of a pair of axles 81 journalled by the supports 76 and includes a pair of idler sprockets 82 and 84 journalled by each end portion of the respective support 76. A plurality of chains 85, one for each sprocket 80, are entrained around the sprockets 80, 82 and 84 in the manner illustrated by FIG. 2 with the respective vertical ends of the chains 85 secured to the bundle frame top and bottom end members 72 and 74, as best shown by FIG. 1.

The platform motor drive means 42 comprises a reversible motor 86, mounted on the depending surface of the platform 78 and by belt and pulley and transmission means 88, drives a stub axle 90 having a pair of sprockets 92 thereon with a pair of chains 94 entrained around the respective sprockets 92 and a pair of drive sprockets 96 mounted on the respective axle 81 whereby rotation of the motor 86 drives the driven sprockets 80 to raise or lower the platform 78 in accordance with the respective direction of rotation of the motor 86.

Since the size of the picket stock bundle 40 is relatively large, for example 48 inches high, 48 inches wide and a length of at least four feet, the bundle 40 is deposited upon the platform 78 by a forklift truck, or the like, not shown.

Operation of the platform motor in one direction elevates the platform and picket stock bundle 40 until one lateral edge of the topmost layer 40A contacts the trigger means 56 for actuating the picket stock layer lifting means 46–52 in the manner presently explained.

LAYER LIFTING MEANS

The pair of layer lifting means 46 and 48 are substantially identical and similarly the pair of layer lifting means 50 and 52 are substantially identical and in the interest of brevity only the lifting means 46 and 50 will be described in detail.

Referring more particularly to FIGS. 7 through 10, the layer lifting means 46 comprises a substantially triangular-shaped, when viewed in side elevation, frame 98 having its base 99 disposed upwardly and connected with the bundle frame top member 72 (omitted for clarity in FIGS. 7–10). A pair of sprockets 100 and 101 are journalled by horizontal parallel axles on the base 99 and a third sprocket 102 (FIGS. 9 and 10) is secured to the depending end portion of the triangular frame. The axle for the sprocket 101 extends between the lifting means 46 and 48. A chain 104 is entrained around the three sprockets 100, 101 and 102 with the end portions of the chain 104 disposed vertically and secured to one end of a vertically movable bracket 106. The lift means 46 further includes a push lever 108 pivotally mounted intermediate its ends on the triangular frame 98, for vertical pivoting movement. A push bar 110 extends transversely of the bundle frame 34 and is connected with the depending end of the pivoting push levers 108 of the pair of layer lifting means 46 and 48, for the purposes presently explained. A generally vertical picket stock layer slider lever 112 is similarly pivotally secured to the bracket 106 and includes an elongated slider and lifter element 114 secured to its depending end and extending transversely of the bundle frame coextensive with the picket stock bundle 40 and connected with a companion lever at its other end on the lifting means 48. In its downward at rest position, the bracket 106 closes a microswitch P2 in a cam motor first circuit for the purpose presently explained.

The lifting means 50 similarly comprises a substantially triangular-shaped, when viewed in side elevation, bracket 116 having its base 117 disposed horizontally and secured to the frame top side member 72. The longitudinal spacing between the lifting means bracket 116 with respect to the lifting means bracket 98 is selected in accordance with the length of the picket stock being conveyed and, in the example illustrated, is disposed intermediate the length of the picket bundle frame 34. The triangle frame base 117 similarly journals, on horizontal axles in horizontally spaced relation, a pair of sprockets 118 and 119 with the axle for the sprocket 119 extending between the lifting means 50 and 52. The hypotenuse 120 of the triangular frame 116 has a plurality of similar sprockets 121, 122, 123 and 124 journalled thereon with their horizontal axes arranged in staggered relation longitudinally of the hypotenuse for receiving an endless chain 126 entrained over the respective sprockets in the manner illustrated and for the purpose presently explained.

Picket stock layer lift bracket means 128 is secured to the chain 126 in vertically spaced relation and supports, at its depending limit, an angle lift bar 130 extending between the lifting means 50 and 52 for lifting one end of the uppermost layer 40A of the picket stock, as presently explained. The bracket means 128, when in its at rest position. similarly closes a microswitch P3 in a cam motor first circuit for the purpose presently explained.

The lifting means 50 further includes a pusher lever 132 pivotally connected intermediate its ends for vertical pivoting movement about a horizontal axis to the triangle frame 116. The pusher lever 132 similarly supports at its depending end a push bar 134 similarly coextensive with the width of the picket bundle 40 and supported at its other end by the companion lifting means 52.

CAM MEANS

Figure 2:
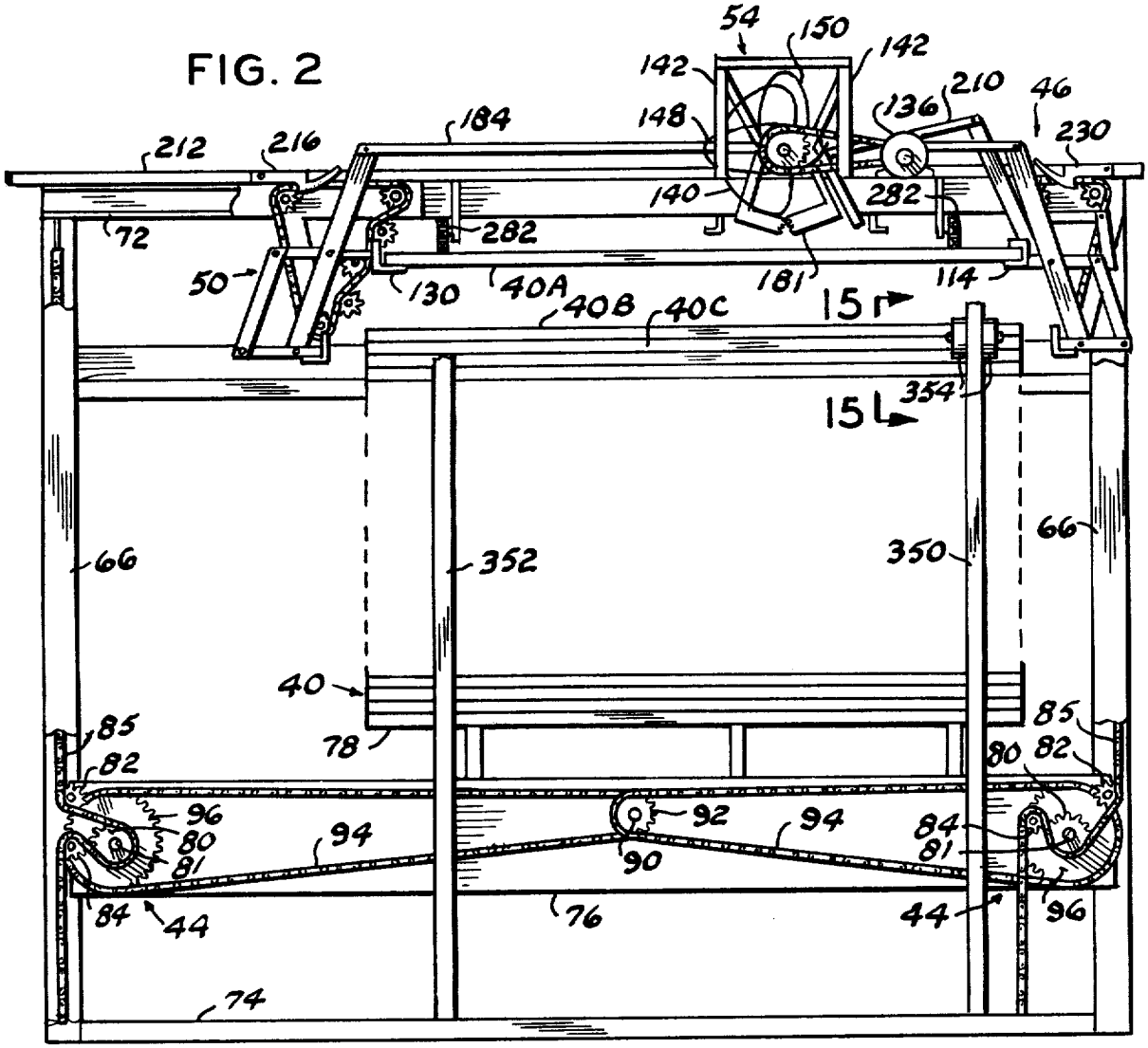
FIG. 2 is a right side elevational view of FIG. 1 with parts broken away for clarity.
Figure 7:
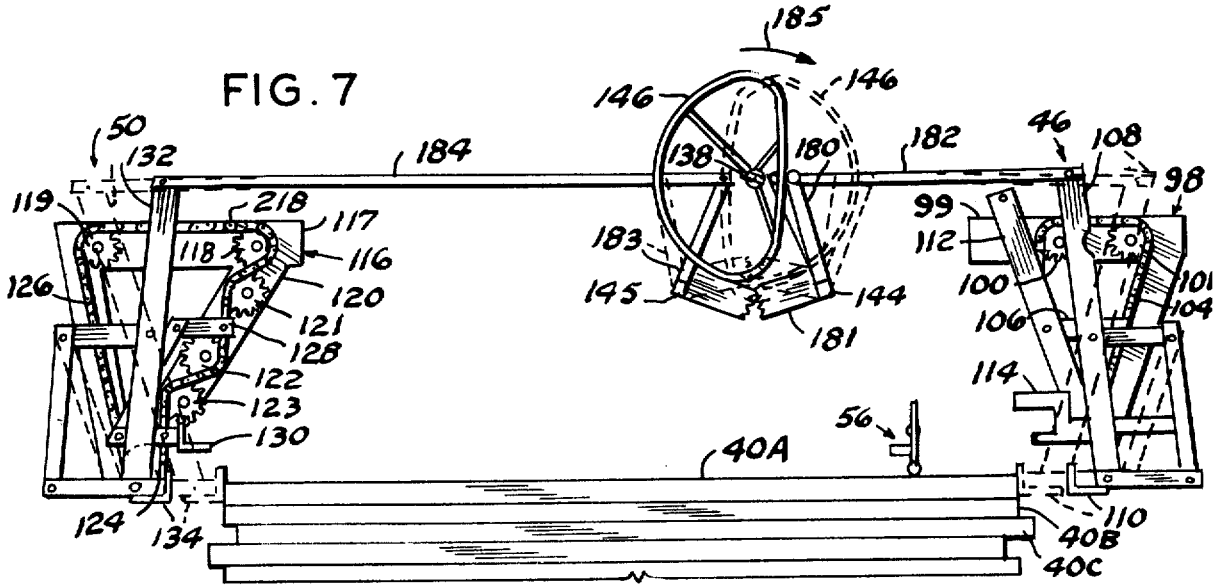
Figure 4:
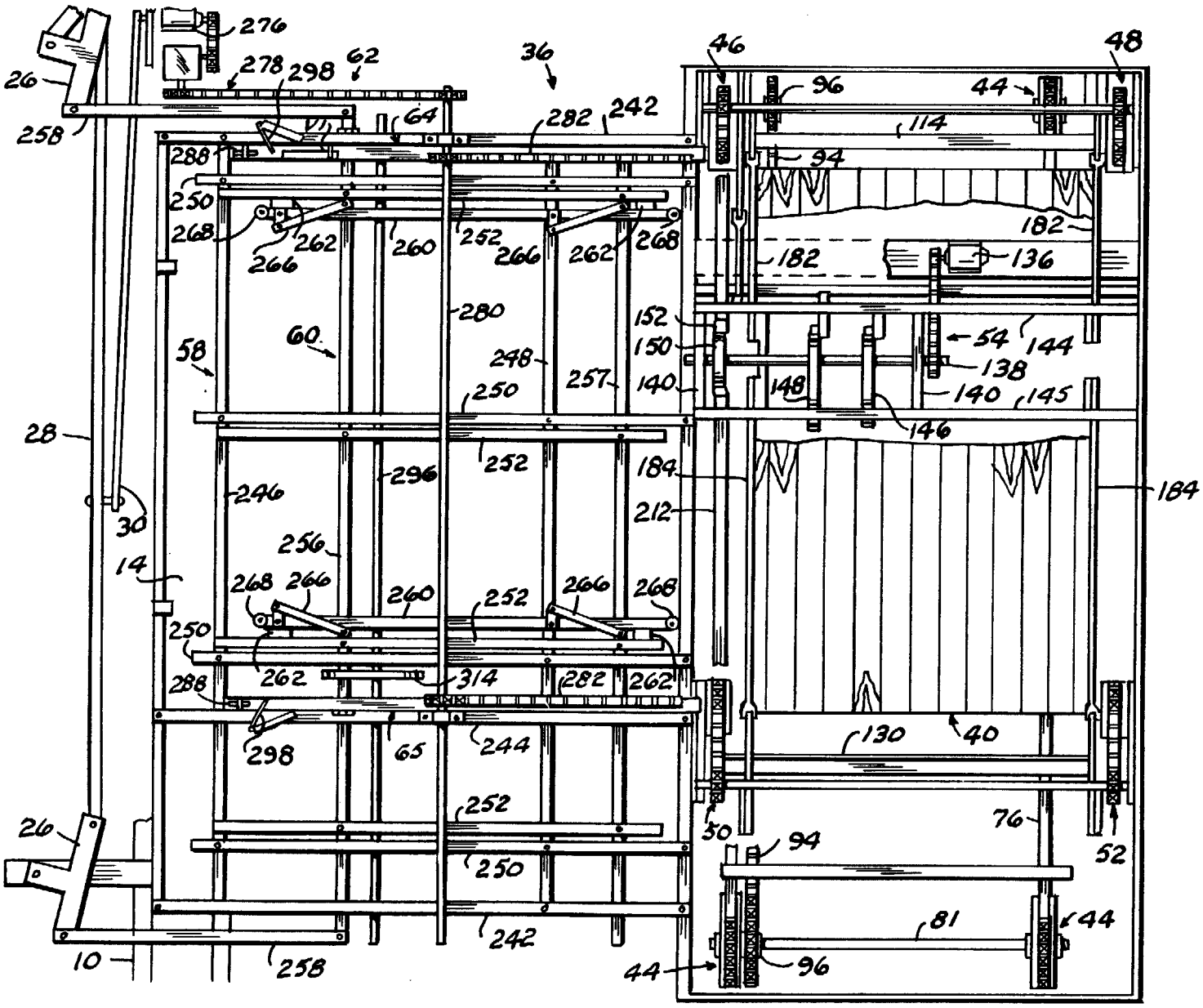
FIG. 4 is a top view of FIG. 1 illustrating the reciprocating frame in another position.

Referring also to FIGS. 2 and 4, the cam means 54 includes a cam motor 136 drivably connected with and angularly rotating a cam shaft 138 journalled by cross members 140 extending between upright 142 supported by cross members 144 and 145 extending transversely of the upper limit of the bundle frame 34 intermediate its ends. The cam shaft 138 has secured thereto a plurality of cams designated as a pusher cam 146, a slider cam 148 and picket stock layer lifting cams 150 and 152 which operate the respective components of the lifting means 46–52.

CAM TRIGGER MEANS

Referring also to FIGS. 15 through 18, the cam trigger means 56 includes a rotatable trigger element 154 comprising an elongated rod 156 vertically slidably projecting through a trigger plate 158 horizontally mounted on a bundle frame horizontal cross brace 160 extending between the posts 66 adjacent the side of the picket bundle facing the horizontal frame means 36. Intermediate its ends the rod 156 is provided with three horizontally disposed rollers 161, 162 and 163 arranged in 90° angular relation with respect to each other about the axis of the rod 156 and vertically spaced-apart a distance equal to the thickness of the respective picket stock members 41 forming the bundle 40. Intermediate its ends and spaced below the rollers, the rod 156 is surrounded by a horizontal square plate 164 having a plurality, four, upwardly and inwardly inclined rods 166 journalling a like plurality of vertically disposed rollers 168. The square plate 164 is nested by an L-shaped bracket 170 (FIG. 17) mounted on the upper surface of the trigger plate 158 for the purpose of insuring that the respective roller 161–163, in turn overlying the adjacent stock member 41, is disposed normal to the longitudinal axis of the picket stock members when the cam trigeer 154 is sequentially rotated about its vertical axis. The uppermost end of the trigger rod 156 is vertically slidably supported by an arm 172 mounted on the bundle frame above the uppermost roller 163. A disk-like trigger rod plate 174 is secured to the rod 156 for contacting the switch arm of the microswitch T1 supported by the bundle frame below the arm 172.

The platform motor means 42 elevates the platform 38 until the horizontal plane of the uppermost layer 40A of the picket stock is adjacent the depending limit of the lowermost trigger roller 161 and the picket stock member 41 adjacent the trigger means 56 lifts the trigger element 154 by contact with the roller 161 until the trigger rod plate 174 operates the microswitch T1 to denergize the platform motor 86 and energize the cam motor 136.

The pusher cam 146 (FIG. 7) includes a cam roller 178 contacting the pusher cam 146 and mounted on a pusher cam crank arm 180 pivotally supported by one of the cam supports 144. The roller connected end of the crank arm 180 is connected by a rod 182 with the push lever 108 of the lifting means 46. The other end portion of the crank arm 180 is pivoted with a rack 181 cooperatively engaging a companion crank arm 183 and rack similarly supported by the opposing cam support 145. The crank arm 183 is similarly connected with the push lever 132 of the lifting means 50 by a rod 184. Angular rotation of the push cam 146 about the axis of the cam axle 138 in the direction of the arrow 185 pivots the push lever 108 to force its push bar 110 against the adjacent end surfaces of the picket stock top layer 40A while simultaneously through the crank arm rack means the other push lever 132 is similarly pivoted to force its push bar 134 adjacent the opposite end surfaces of the top picket stock layer 40A. This disposes the picket stock layer 40A with all of the ends of the picket members 41 aligned and in position for a subsequent pickup and lifting of the layer 40A. This picket stock end surface alignment is necessary for the reason that during shipment of a picket bundle 40 some of the picket members 41 are moved longitudinally relative to the others and project beyond the respective ends of the bundle. The aligning action is repeated for the three topmost layers during "start-up" as explained below.

The trigger means 56 further includes latch means 186 operated by the push lever 108 during its movement toward and away from the adjacent end of the picket stock layers. The latch means 186 comprises an elongated generally horizontal flexible band 188 having one end portion 190 disposed adjacent the trigger element 154 and its other end portion adjacent the depending end portion of the lift means 46 for longitudinal sliding movement toward and away from the trigger element 154. The band 188 is connected by a link 192 with a trigger finger 194 pivotally supported intermediate its ends on the trigger plate 158 and having a hook end portion 196 engaging one of the trigger element rollers 168 when the picket stock member 41 has elevated the trigger element square plate 164 above its bracket guide 170. When the push bar 110 has returned to its solid line position of FIG. 7, a normally energized solenoid Z1, mounted on the bundle frame above the band 188, for the purposes presently explained, lifts a rod 198 which lifts a roller 200 mounted on an arm underlying the band 188 thus lifting the flexible band 188 so that a latch 202, mounted on the depending end of the push lever 108, engages a catch 204 secured to the upper surface of the band 188 to longitudinally slide the band 188 on the roller 200 to the right, as viewed in FIG. 18. This longitudinal movement of the band 188 pivots the trigger finger 194 to its dotted line position of FIG. 17 and angularly rotates the trigger element 154 about its vertical axis in the direction of the arrow 205 before breaking contact between the finger hook 196 and the roller 168. This angularly rotates the trigger element 154 90° about its axis to dispose its intermediate roller 162 perpendicular to the longitudinal axis and in overlying spaced relation above the picket member 41 as the trigger element falls by gravity into its guide 170. The finger 194 is released to return to its solid line position of FIG. 17 by a fixed position cam 206 lifting the catch 202 out of contact with the latch 204 upon return of the push lever 108 to its solid line position of FIG. 7 wherein a spring 208 biases the finger 194 and band 188 to its solid line position. As the trigger element 154 returns to its downward solid line position of FIG. 18, the microswitch T1 is again operated to energize the platform motor 86 for again lifting the picket bundle 40 into contact with the intermediate trigger roller 162 which repeats the above described cycle aligning the ends of the picket forming members forming the next lower layer 40B of the picket stock with the previously aligned ends of the layer 40A. The cycle is repeated a third time in an indentical manner thus aligning the three topmost layers 40A, 40B and 40C of the picket bundle.

As the trigger element 154 is angularly rotated to move its topmost roller 163 off of the topmost picket layer 40A, all three rollers of the trigger member are disposed laterally of the picket bundle permitting the platform motor 86 to elevate the picket bundle until it contacts and operates the microswitch T1 which interrupts upward picket bundle movement with its upper limit adjacent the horizontal plane defined by the slider and lifter element 114.

After operating the microswitch T1, the picket bundle 40 contacts and opens a microswitch PS deenergizing the solenoid Z1 and its companion Z2 for the purpose presently explained.

Figure 8:
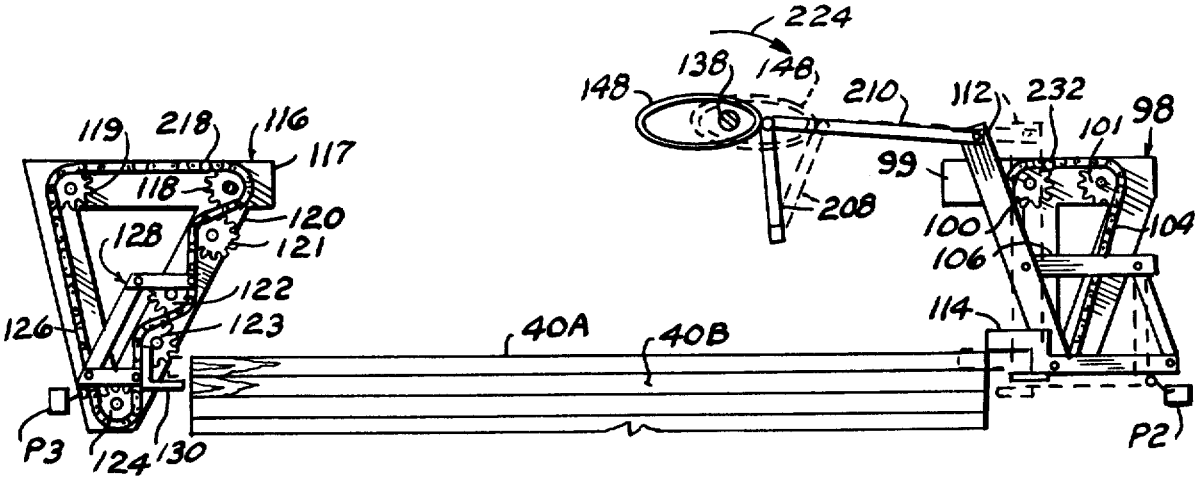
Figure 9:
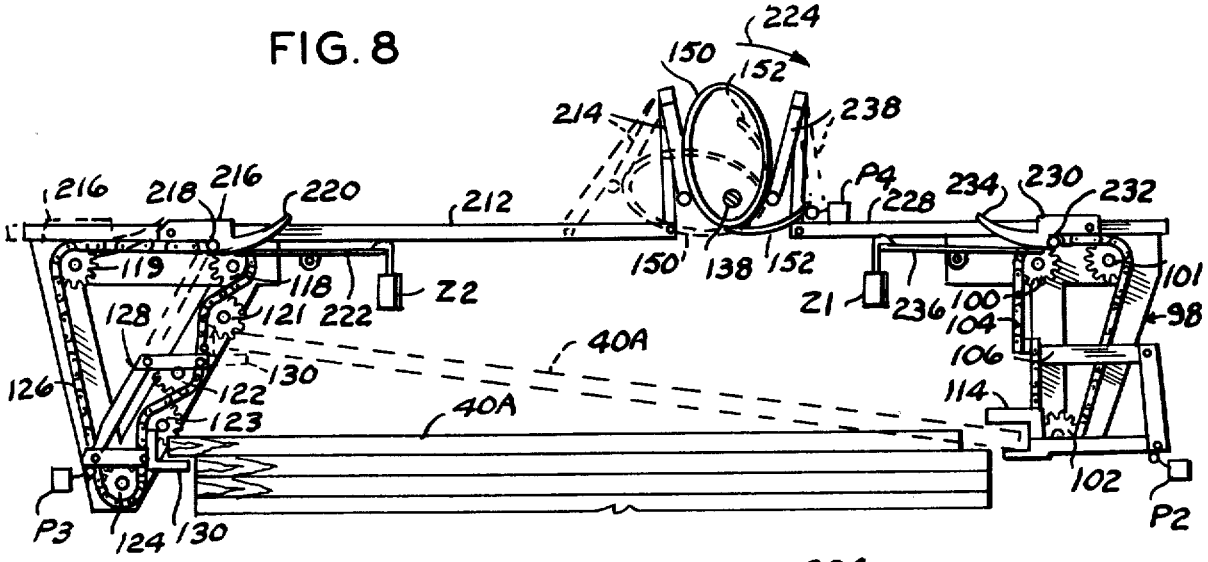

Referring more particularly to FIG. 8, the picket handle operation of the microswitch T1 energizes the cam motor 136 wherein the cam shaft 138 rotates the slider cam 148 to pivot a slider cam arm 208 pivotally connected by a rod 210 with the slider lever 112 and force the slider element 114 against the adjacent end surfaces of the topmost picket layer 40A to slide this top layer as a unit to the left, as viewed in FIGS. 8 and 9, to dispose the opposite end portion of the top layer in overlying relation with respect to the lift bar 130 of the lifting means 50 and 52.

Figure 11:
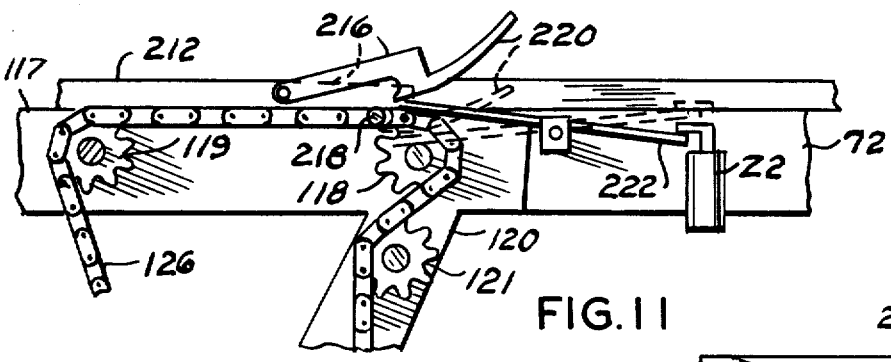
FIG. 11 is a fragmentary elevational view, to a larger scale, illustrating the operation of the chain engaging latch elevating the second lift arm.
Figure 10:
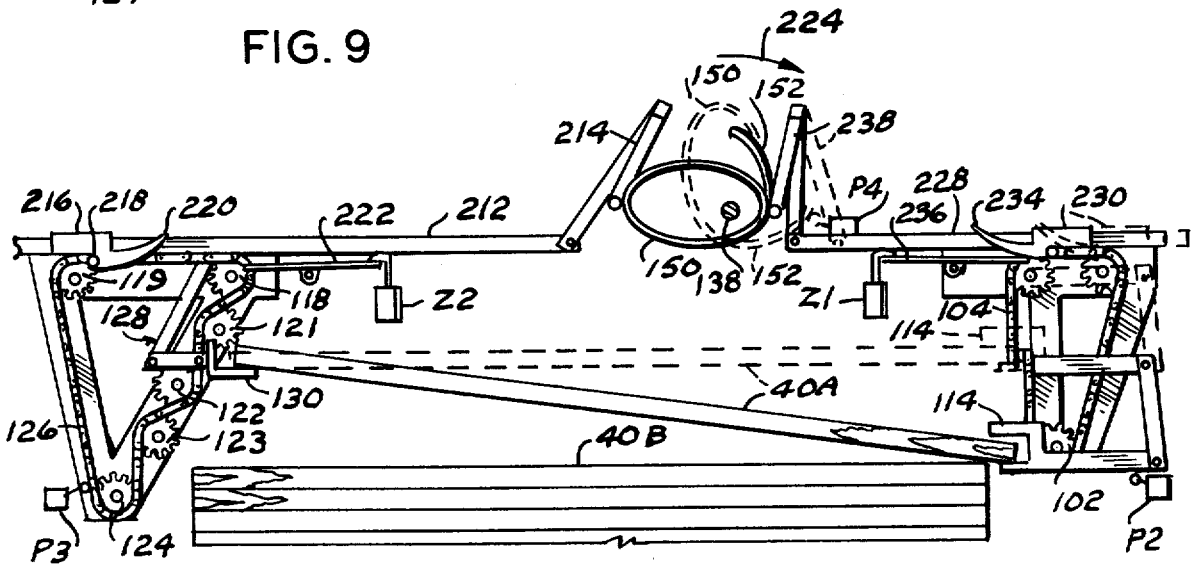

Referring now to FIGS. 10 and 11, an elongated rail 212 overlies the chain 126 in that portion extending between the lifting means 50, sprockets 118 and 119. One end of the rail 212 is connected by pivoting cam arms 214 contacted and pivoted by the lift cam 150. Intermediate its ends, the rail 212 is provided with a latch 216 vertically pivotally connected therewith which includes a hook portion for engaging a lug 218 secured to the chain 126 in which the lug limits movement of the chain in a to and fro direction between the sprockets 118 and 119. The latch 216 is lifted off the chain by its arms 220 sliding on one end of a lever 222 controlled by the solenoid Z2 when energized. The cam 150 rotates in the direction of the arrow 224 which moves the rail 212 longitudinally toward the left, as viewed in FIG. 9, so that the latch 216 engages the lug 218 and rotates the chain 126 counterclockwise thus lifting the lift bar 130 and the adjacent end portion of the picket layer 40A which also moves the layer 40A toward the right, as shown by dotted lines (FIG. 10), in a sliding action as the lifting bracket 128 moves upwardly and between the sprockets 122 and 123 to dispose the other end portion of the picket layer 40A within the confines of the lifter element 114 of the lifting means 46 and 48. Final movement of the lift bar 130 between the sprockets 122 and 123 lifts the adjacent end of the picket layer 40A vertically to a desired position where it is secured in this upper position by a latch forming a mirror image of a latch 226, illustrated by FIG. 14, for the lift means 46.

A companion rail 228 similarly longitudinally slidably overlies the lifting means 46 chain 104 between its sprokcets 100 and 101 and is similarly provided with a latch 230 engaging a lug 232 secured to the chain and movable between the sprockets 100 and 101. The latch includes arcuate arms 234 similarly overlying a solenoid actuated arm 236 controlled by the solenoid Z1. Rotation of the cam shaft 138 rotates the companion lift cam 152 for pivoting a roller equipped cam lever 238 to move the rail 228 toward the right, as shown by dotted lines (FIG. 10), and elevate the slider and lifter element 114 and adjacent end portion of the picket layer 40A to the horizontal plane of its previously lifted end portion. The slider and lifter element 114 is latched in its uppermost position by the latch arm 226 having a lift portion 240 spring urged to engage the element 114. The uppermost layer 40A is now disposed in horizontal alignment for movement toward the frame means 36 and closes a microswitch C2 connected in parallel with the microswitch C1 of the picket pointing machine motor circuit. In its at rest position the lift cam 152 opens a microswitch P4 in a second circuit to the cam motor 136. Angular rotation of the cam shaft 138 moving the lift cam 152 permits the microswitch P4 to close and maintain the cam motor 136 energized to complete one revolution of the cam shaft after the microswitches P2 and P3 open in response to upward movement of the slider and lift element 114 and angle bar 130.

HORIZONTAL FRAME MEANS

Referring again to FIGS. 1, 3 and 4, the horizontal stationary frame means 58 includes elongated end members 242 and an intermediate member 244 extending between and connecting the bundle frame means 34 with the picket pointing machine 10. A pair of elongated supports 246 and 248 extend between the stationary frame end members 242 and are rigidly connected therewith. Stationary frame cross members 250, four in the example shown, extend transversely of the elongated supports 246 and 248 in parallel spaced relation longitudinally of the stationary frame means 36 are rigidly connected therewith for normally supporting a picket stock layer.

The horizontally reciprocating frame means 60 comprises a plurality of elongated picket layer lift members 252, four in the example shown, disposed in close spaced parallel relation adjacent and of shorter length than the stationary cross members 250 which normally slidably overlie and are supported at their respective end portions by the elongated supports 246 and 248.

Figure 6:
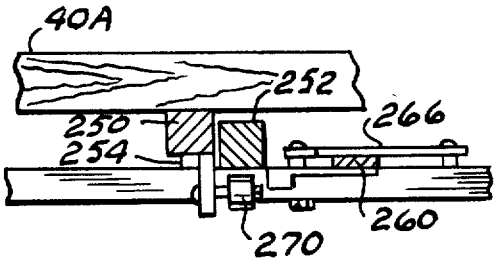
FIG. 6 is a fragmentary vertical cross sectional view, to a larger scale, taken substantially along the line 6—6 of FIG. 5.

As shown by FIG. 6, a spacer 254 is interposed between the transverse stationary cross members 250 and the elongated supports 246 and 248 at their point of juncture for disposing the plane of the upper surface of the transverse cross members 250 above the horizontal plane of the sliding picket stock layer lift members 252 so that the depending surface of a picket stock layer 40A overlying the transverse cross members 250 is normally spaced above the reciprocating layer lift members 252, for the purposes presently apparent.

An elongated reciprocating frame drive bar 256 extends longitudinally of the fixed frame 58 below the cross members 250 and 252, intermediate their ends, and are bolted to one end portion of the sliding layer lift members 252. An idler drive bar 257 extends between the frame end members 242 and is similarly bolted to the other end portions of the layer lift members 252. The respective ends of the drive bar 256 are connected with one arm of each bell crank 26 by a pair of pitmans 258 so that horizontal movement of the crank arms 26, by the picket pointing machine 10, reciprocates the layer lift members 252 back and forth within lateral limits of the stationary frame 58 between the picket pointing machine 10 and the bundle frame means 34.

Figure 3:
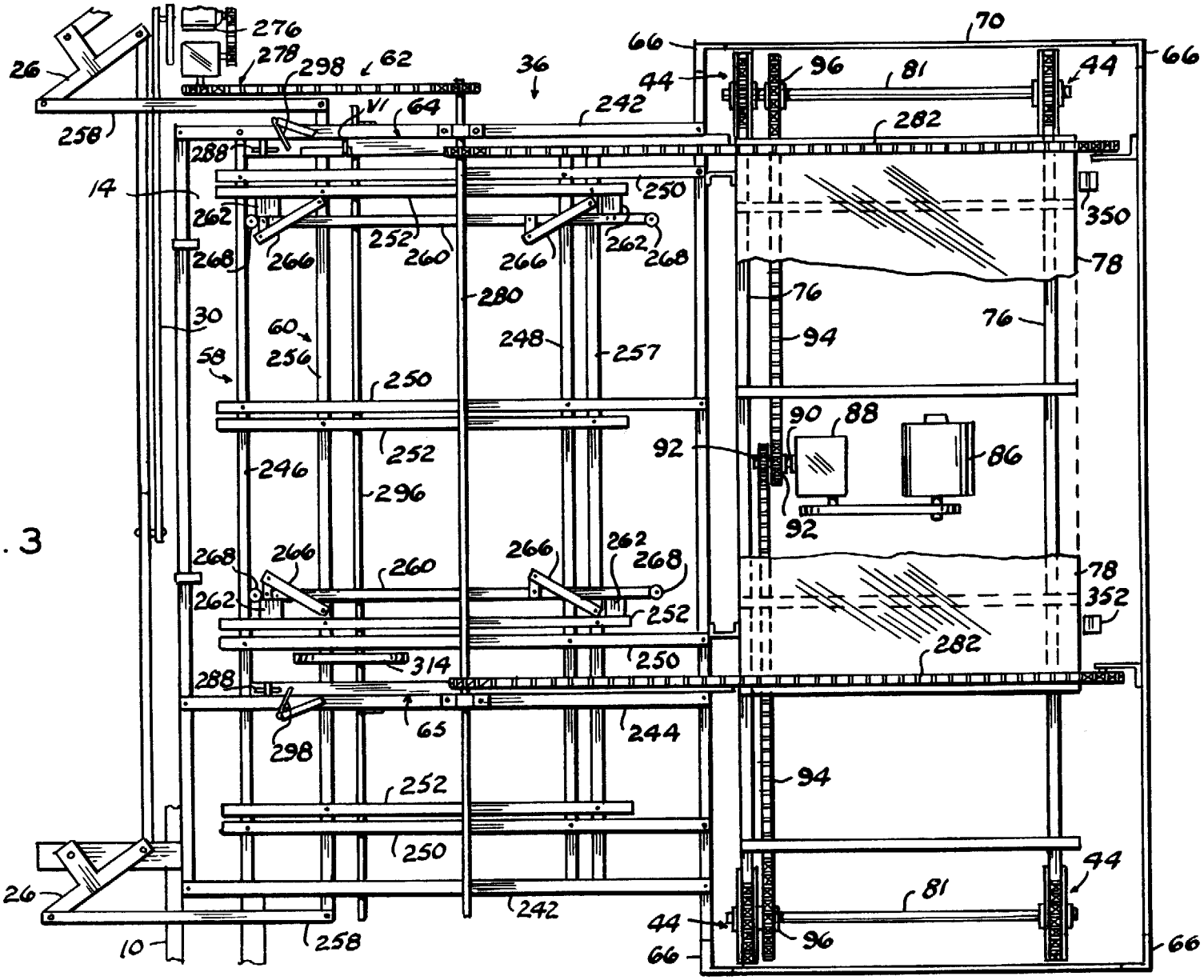
FIG. 3 is a top view of FIG. 1 with the bundle frame layer lifting members removed for clarity and illustrating the reciprocating frame in one position.
Figure 5:
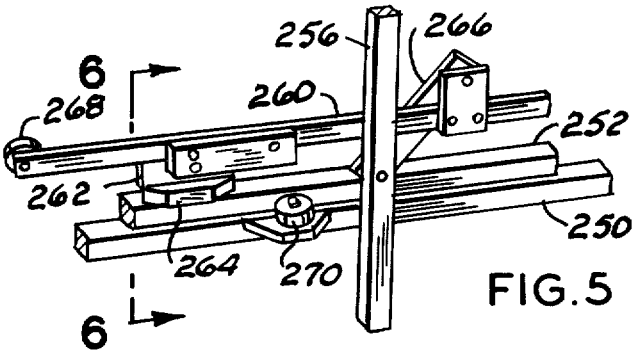
FIG. 5 is a fragmentary perspective view, to a larger scale, of a bottom portion of the horizontal frame illustrating the components for lifting the reciprocating frame.

Referring also to FIG. 5, a pair of elongated strap metal guide bars 260 overlie, at their respective end portions, the fixed frame support 248 and drive bar 256. The guide bars 260 are each provided adjacent their respective end portions with a laterally projecting extension 262, having a depending cam 264 on their lowermost surface normally disposed adjacent the respective layer lift member 252. Two pairs of pitmans 266, respectively connected with each guide bar 260 adjacent its respective ends, move the guide bars 260 laterally toward the respective layer lift member 252 in response to contact of the respective guide bar 260 with the adjacent side wall of the bundle frame 34 when moved in one direction and contacting the stationary frame support 246 when moved in the opposite direction. The respective ends of the guide bars 260 journal friction reducing rollers 268 to facilitate lateral movement of the guide bars toward and away from the layer lift members 252. When the guide bars 260 are moved as a unit with the layer lift members 252 the rollers 268, on the guide bars, stop movement of the guide bars toward the bundle frame and cause the pitmans 266 to bias the guide bars toward the adjacent layer lift members 252 so that the cams 264 are disposed under the layer lift members 252 and ride over a like plurality of rollers 270 supported by the depending surface of the frame cross bars 250 and projecting laterally thereof in the path of travel of the cams 264 as they move toward the picket pointing machine 10. This results in the reciprocating layer lift members 252 being lifted above the plane of the fixed frame cross members 250 to support the lowermost surface of the overlying picket layer 40A above the fixed frame cross members 250 so that the picket layer 40A moves with the reciprocating frame 60 toward the picket pointing machine and the lateral picket member 41, adjacent the picket pointing machine, is moved beyond the adjacent ends of the frame cross members 250 to fall by gravity through the throat 14 of the picket pointing machine. As the guide bars 260 move toward the picket pointing machine, to the left and as shown by FIG. 3, and contact the fixed frame member 246, the pitmans 266 bias the guide bars 260 laterally away from the respective adjacent reciprocating cross member 252 and dispose the cams 264 out of alignment with the rollers 270 and supporting contact with the picket layer 40A.

LAYER STORAGE MEANS

Figure 13:
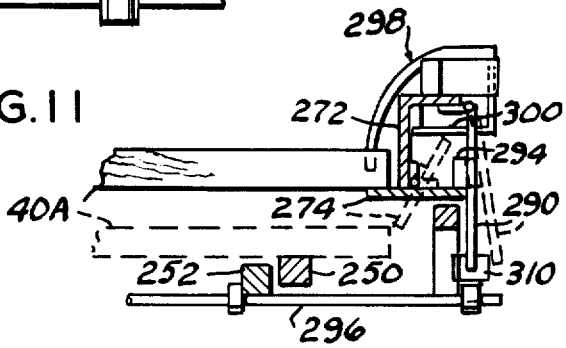
FIG. 13 is a vertical cross sectional view taken substantially along the line 13—13 of FIG. 12.
Figure 12:
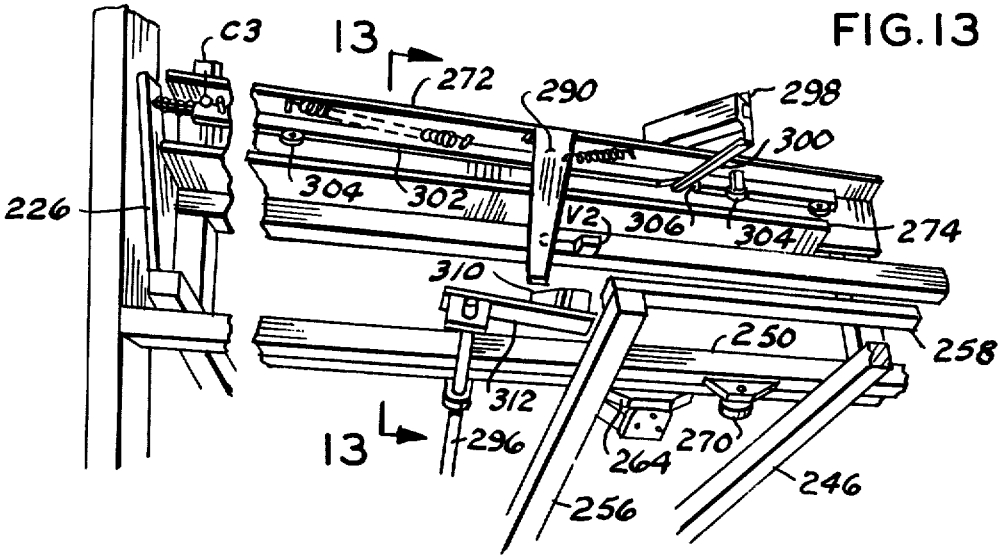
FIG. 12 is a fragmentary perspective view of one end of the horizontal frame illustrating the tilt shelf and its latch release mechanism.
Figure 14:
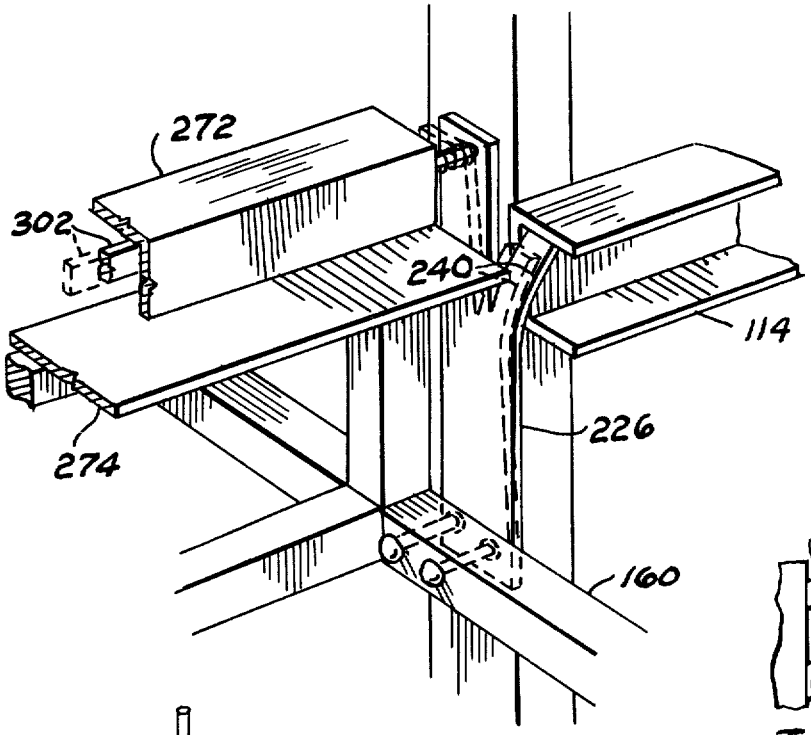
FIG. 14 is a fragmentary perspective view, to a larger scale, illustrating one of the lift bar support latches.
Figure 16:
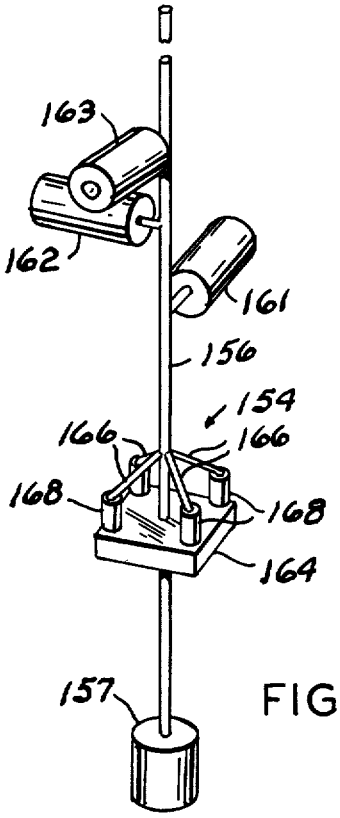
FIG. 16 is a perspective view, to another scale, of the pusher bar actuator.

Referring also to FIGS. 12, 13 and 14, the picket layer storage means 64 and 65 are disposed at respective end portions of the horizontal frame means 36 and are mirror images of each other and only the layer storage means 64 is described in detail. The storage means 64 comprises an angle member 272 overlying the fixed frame means 58 at one of its ends and extends from the picket bundle frame 34 substantially coextensive with the width of the fixed frame. A counterbalanced picket layer and support plate 274 is hingedly connected with the depending edge of the angle member 272 for vertical pivoting movement about a horizontal axis and normally forms a tiltable shelf adjacent the respective angle member 272 projecting toward its companion shelf in the storage means 65 in confronting relation which support the picket layer 40A when disposed thereon.

A drag chain motor 276, supported by the picket pointing machine 10, is connected by chain and sprocket means 278 with a bearing journalled shaft 280 extending longitudinally between and overlying the angle members 272 intermediate their ends.

A pair of endless drag chains 282, entrained around sprockets secured to the shaft 280 and overlying the shelf forming plates 274 are similarly entrained around sprockets 284 supported by the picket bundle frame bundle entry side so that the endless chains 282 are disposed above the upper surface of the picket layer 40A picked up by the lifting means 46–52. Drag lugs 286, secured to the chains 282, engage the right side edge of the picket layer 40A, as viewed in FIG. 1, to move the picket layer 40A in a sliding action from the lifting means supports 114 and 130 to the shelf forming plates 274. The leftmost picket layer stock member 41 contacts a stop 288 and microswitch V1 to open the latter and interrupt operation of the drag chain motor 276 when the picket layer 40A is in a desired position. The picket layer plate 274 is held in horizontal shelf position by a latch 290 depending from and hingedly secured to the angle member 272 (FIG. 13) which includes a stop 294. The latch 290 is spring urged toward the angle member 272 and normally maintains a drag motor circuit microswitch V2 closed. A picket layer release rod 296 extends in underlying relation longitudinally of the frame means 36 adjacent and parallel with respect to the drive bar 256 and is angularly rotatably secured to the reciprocating layer lift members 252.

As the picket layer 40A is moved into position against the stop 288 its leading edge contacts one arm of a bell crank 298 pivotally supported by the angle member 272 so that its other end portion 300 engages a spring returned release bar 302 mounted on rollers 304 on the side of the angle member 272 opposite the picket stock layer so that the bell crank other end 300, engaging a notch 306 on the underside of the release bar, longitudinally slides the release bar 302 toward the picket pointing machine 10 for releasing the latches 226 (FIG. 14) supporting the picket layer lifting elements 114 and 130 which fall by gravity to their start position. The spring biased return of the release bar 302 opens a picket pointing machine microswitch C3 mounted on the angle member 272. Release of the lifting elements 114 and 130 closes the microswitches P2 and P3 and energizes the cam motor 136 to operate the picket layer lifting means 46–52 to pick up another layer of picket stock from the picket bundle 40, as described hereinabove.

A picket layer shelf release cam 310 (FIGS. 12 and 13) is mounted on a cam arm 312 at respective ends of the release rod 296 for the purpose of releasing the picket layer shelves 274 to drop the picket layer 40A on the stationary frame 58. The cams 310 are reciprocated by the frame 60 toward and away from the picket pointing machine and are normally maintained in a downwardly spaced position with respect to the depending end portion of the latch 290 by a counterbalanced release bar 314 angularly secured to the release rod 296 so that one of its end portions is contacted by the depending surface of the overlying picket stock. Thus, as shown by FIG. 1, when the last three members of the picket stock layer have been moved toward the picket pointing machine, the release bar 314 is biased by gravity to angularly rotate the release rod 296 and elevate the cams 310 in position to contact and release the latches 290, as illustrated by dotted lines (FIG. 13), in response to movement of the reciprocating platform 60 in its next movement away from the bundle frame 34 wherein the mass of the picket layer 40A pivots the picket shelves 274 downwardly and deposits the picket layer on the stationary frame 58. Release of the picket layer 40A from the shelves 274 closes the conveyor microswitch V1 and when the shelves are again secured by the latch stops 294 the shelf microswitch V2 is closed thus energizing the drag chain motor 276 to move another layer of picket stock from the lifting means elements 114 and 130 by the drag chains 282.

CONTROL CIRCUIT

Figure 19:
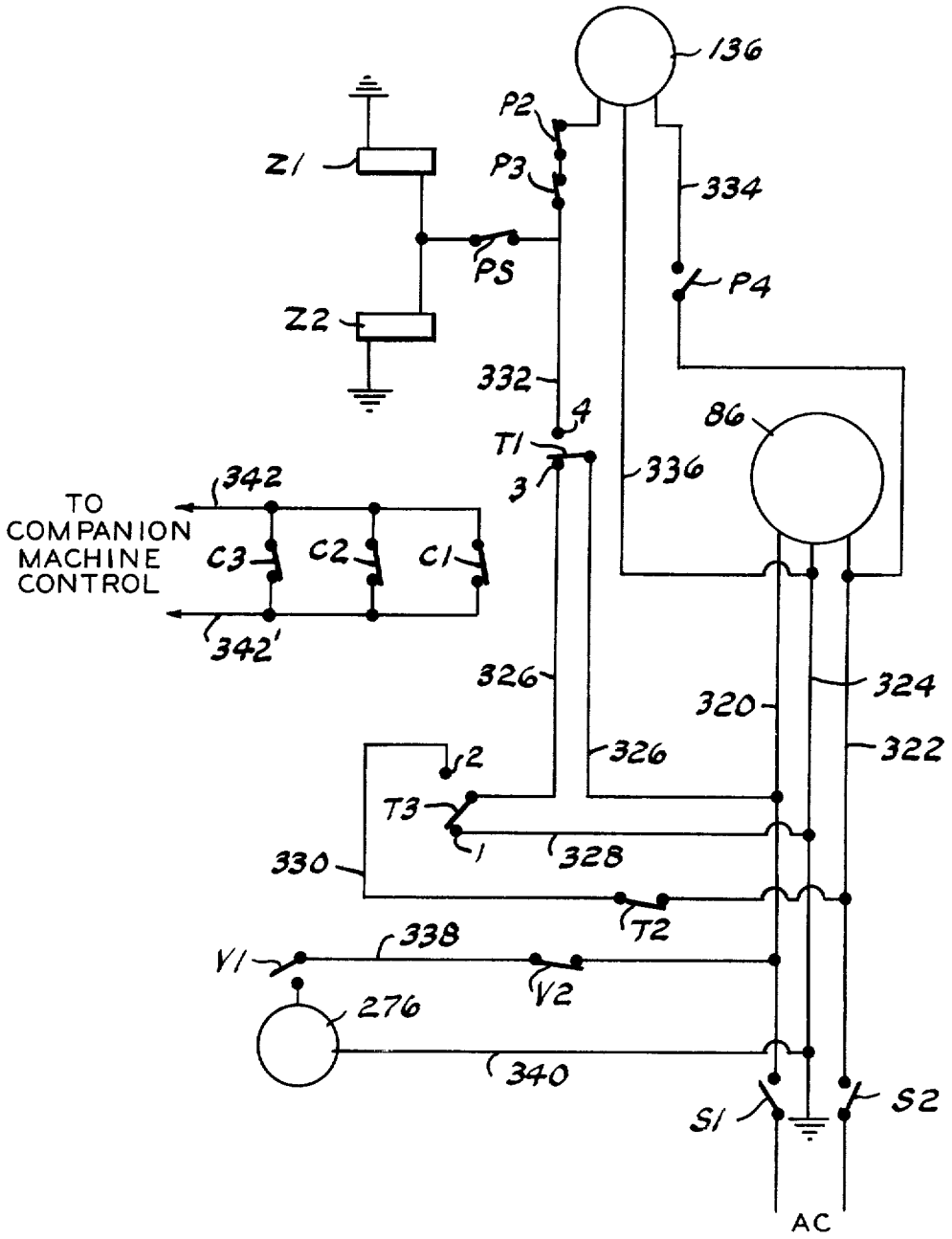

Referring also to FIG. 19, the platform motor 86 is connected with a source of electrical energy through two source wires 320 and 322 and a ground wire 324 with starting switches S1 and S2 interposed in the source wires. A platform motor operating circuit, including two wires 326 and 328, are respectively connected with the source wire 320 and ground wire 324, with wires 326 and 328 joined by an up-down platform microswitch T3, having contacts 1 and 2. The microswitch T1, having contacts 3 and 4, is connected in series in the wire 326 and is normally closed with its terminal 3. Terminal 2 of the microswitch T3 is connected by a wire 330 with the other source wire 322 through a series connected platform "down" limit switch T2. Terminal 4 of the microswitch T1 is connected to a wire 332 which forms one source wire for the cam motor 136. The microswitches P2 and P3 are interposed in series in the wire 332. Another source wire 334 connects the cam motor 136 with the other source wire 332 through normally open switch P4. The cam motor ground wire 336 is connected with the ground wire 324. One end of the coils of the solenoids Z1 and Z2 are connected with the cam motor source wire 332 between the microswitches T1 and P3 and through the solenoid microswitch PS. The drag chain motor 276 is connected with the source wires 320 and 322 by a pair of wires 338 and 340 with the microswitches V1 and V2 interposed in series in the wire 338.

A wire 342, forming one of the source wires for operating the picket pointing machine motor 18, is divided to form two wires 342 and 342' and the three microswitches C1, C2 and C3 are connected in parallel across these two wires so that when any one of these three switches remains closed the picket pointing machine continues in operation with the picket stock conveyor machine 32. Microswitch C1 is mounted on the platform 78 and normally maintained closed by the picket bundle 40 overlying the platform. The microswitch C2 is mounted on the bundle frame 34 and closed by a layer of picket stock when lifted by the lifting means 46–52. The normally closed microswitch C3 is mounted on the shelf supporting angle member 272 and opened by the release bar 302, as explained hereinabove. The purpose of the three microswitches C1, C2 and C3 is to insure operation of the picket pointing machine when any one of the three switches are closed and to interrupt the operation of the picket pointing machine 10 in sequence with the operation of the conveyor 32 when all three microswitches C1, C2 and C3 are simultaneously open and at that point in its operation in which the last picket stock layer of the bundle 40 has been moved to a stored position on the shelves 274.

OPERATION

In operation, assuming the picket bundle 40 has been deposited on the platform means 78, when in its lowermost position, which closes the microswitch T3 with its terminal 1 and closes the picket pointing machine microswitch C1. A pair of bundle posts 350 and 352 (FIGS. 1 and 2) are vertically disposed in and connected with the bundle frame adjacent the platform 78 for preventing a spread apart action of the picket stock when the retaining bands are cut. Spring biased wheels 354, on the bundle post 350, maintain the opposite side of the top layers in contact with that side of the bundle frame. The starting switches S1 and S2 are closed which energizes the platform motor 86 to lift the picket bundle until it closes microswitch T1 with its terminal 4 thus stopping the platform motor 86 and simultaneously closing a circuit to the cam motor 136 through microswitches P2 and P3 closed by the released or down position of the lifting elements 114 and 130. The solenoids Z1 and Z2 are also simultaneously energized through the normally closed microswitch PS to prevent elevation of the layer lifting elements 114 and 130. As the cam motor 136 rotates the cam shaft 138, the lift cam 152 releases the microswitch P4 which closes and completes a companion circuit to the cam motor 136 to maintain it energized as the topmost layer of the picket bundle releases the microswitch T1 to make with its terminal 3 to insure one complete revolution of the cam means in its cycle of operating the pusher levers 108 and 132 aligning the ends of the top three layers of the picket bundle by the trigger means 56, as described hereinabove.

After the three top layers picket stock ends have been aligned, upward movement of the picket bundle closes the microswitch T1 with its terminal 4 and opens the solenoid energizing switch PS to permit full operation of the lifting means 46–52 in lifting the topmost layer of the picket bundle which when lifted opens the picket pointing machine microswitch C2. During initial start-up one of the drag chain motor circuit microswitches V1 or V2 is manually opened until the topmost picket stock layer has been lifted. That microswitch is then closed and the drag chain motor 276 operates to move the lifted picket stock layer to the stored position on the shelves 274. The picket pointing machine 10, by its bell cranks 26, releases the shelves for the picket layer to fall by gravity on the stationary frame 58 and operates the reciprocating frame means 60 to progressively move the picket stock, one at the time, into the throat 14 of the picket pointing machine. This feeding of the picket stock to the picket pointing machine progresses until the picket bundle frame, by its lifting means 46–52, picks up the last layer of picket stock which is transferred to a stored position on the shelves 274. After the last layer of the picket bundle has been picked up and transferred to a stored position on the shelves 274, the absence of picket stock on the platform means 38 closes the platform microswitch T3 with its terminal 2 to reverse the platform motor 86 and lower the platform 78 until the platform opens its down limit microswitch T2. Simultaneously with the lowering of the platform means 38 the absence of the picket stock on the platform opens the picket pointing machine microswitches C1 and C2 with microswitch C3 being opened by the spring return of the bar 302 thus interrupting operation of the picket pointing machine in sequence with the operation of the conveyor 32 until another bundle of picket stock 40 is placed on the platform means 38.

Obviously the invention is susceptible to changes or alterations without defeating its practicability. Therefore, I do not wish to be confined to the preferred embodiment shown in the drawings and described herein.

I claim:

1. In a conveyor for sequentially moving a plurality of elongated workpieces from a workpiece bundle to the throat of an upstanding workpiece processing machine having at least one laterally projecting longitudinally reciprocating pitman, at its upper limit, said workpiece bundle comprising a plurality of superposed horizontal layers of juxtaposed elongated workpieces, the improvement comprising:

upright bundle frame means including a motor driven platform disposed laterally of said workpiece processing machine for receiving and elevating a bundle of workpieces a predetermined distance;

stationary frame means extending horizontally between the upper limit of said bundle frame means and said workpiece processing machine for normally supporting a workpiece layer when deposited thereon;

workpiece layer lifting means supported by said bundle frame means for lifting and horizontally supporting the topmost layer of said workpiece bundle, as a unit, in a plane spaced above said workpiece bundle and said stationary frame means;

cam means overlying said bundle frame means and connected with said workpiece layer lifting means for operating said workpiece layer lifting means in response to said bundle frame means elevating said workpiece bundle said predetermined distance;

drag chain means overlying said stationary frame means and extending into said bundle frame means for moving said horizontally supported workpiece layer laterally to an overlying position with respect to said stationary frame means; and, movable frame means within and supported by said stationary frame means and connected with said reciprocating pitman for reciprocating movement between said bundle frame means and said workpiece processing machine and lifting an overlying workpiece layer relative to said stationary frame means and moving said overlying workpiece layer laterally a distance equal to the transverse width of each workpiece of the workpiece layer during each movement toward the workpiece processing machine.

2. The combination according to claim 1 in which said workpiece layer lifting means includes:

at least one workpiece layer lifting means disposed within said bundle frame adjacent the vertical plane defined by the respective end surfaces of said workpiece bundle, said workpiece layer lifting means comprising:

first and second triangular frames each having a vertical side surface;

a first and second plurality of sprockets journalled by like pluralities of horizontal axles secured to the respective said triangular frame side surface;

first and second lift chains entrained around the respective said plurality of sprockets; and, first and second workpiece layer end portion engaging and lifting elements respectively secured to said first and second chain and being at least coextensive with the transverse width of the workpiece layer.

3. The combination according to claim 2 and further including:

an upright workpiece layer slider lever supported intermediate its ends for vertical pivoting movement by said first triangular frame and connected at its depending end with said first layer lifting element.

4. The combination according to claim 3 in which said cam means includes:

a cam shaft;

a cam motor for angularly rotating said cam shaft;

slider cam means including a slider cam mounted on said cam shaft and operatively connected with said slider lever for moving said first layer lifting element toward the adjacent end portion of and longitudinally sliding the topmost workpiece layer with respect to the remaining workpiece layers and disposing its opposite end portion in overlying relation with respect to said second layer lifting element;

first layer lifting cam means mounted on said cam shaft and operatively connected with said second lift chain for moving said second lift chain longitudinally around said second plurality of sprockets and lifting said second lift element and said workpiece layer opposite end portion while simultaneously moving said topmost workpiece layer longitudinally with respect to the remaining layers and disposing its first named end portion in overlying position with respect to said first workpiece layer lifting element; and, second layer lifting cam means mounted on said cam shaft and operatively connected with said first lift chain for moving said first lift chain longitudinally around said first plurality of sprockets and lifting said first layer lifting element and the first named end portion of said workpiece layer to a common horizontal plane.

5. The combination according to claim 4 in which said stationary frame means includes:

at least one pair of stationary cross members extending between said bundle frame means and the throat of said workpiece processing machine in parallel spaced-apart relation; and, a pair of elongated supports extending in parallel spaced-apart relation transversely of said cross members and secured to the depending surface thereof.

6. The combination according to claim 5 in which said movable frame means includes:

at least one pair of longitudinally reciprocating cross members overlying said elongated supports in parallel close spaced relation with respect to said pair of stationary cross members with the upper surface of the reciprocating cross members normally disposed in a horizontal plane spaced below the horizontal plane of the upper surface of said stationary cross members;

drive bar means connecting said pair of reciprocating cross members with said reciprocating pitman;

a pair of guide bars respectively slidably supported by said elongated supports in parallel relation adjacent the respective one of said pair of sliding cross members;

guide pitman means connecting said guide bars with said reciprocating cross members for moving said guide bars laterally toward and away from said reciprocating cross members in response to movement toward and away from said bundle frame, said guide bars each having a lateral extension at its respective end portion projecting horizontally toward the respective one of said pair of reciprocating cross members in underlying relation with respect to the depending surface thereof; and, a depending cam secured to the depending surface of each said guide bar extension, said pair of stationary cross members each having a longitudinally spaced-apart pair of laterally projecting rollers disposed below the travel path of said reciprocating cross members.

7. The combination according to claim 6 and further including:

picket layer storage means extending between said bundle frame means and said workpiece processing machine for normally supporting a workpiece layer in overlying relation with respect to respective end portions of said stationary frame means, said workpiece layer storage means comprising;

normally horizontal shelf means including a pair of plate-like shelves disposed in the horizontal plane defined by the depending surface of said horizontally supported topmost workpiece layer and in longitudinal alignment with the respective end portions thereof;

latch means normally maintaining said shelves horizontal; and, latch release means secured to said movable frame means for releasing said latch means in response to the absence of workpieces on said stationary frame.

8. The combination according to claim 7 in which said drag chain means includes:

a drag chain shaft overlying said workpiece layer storage means;

drag chain motor means for angularly rotating said drag chain shaft; and, a pair of chain and sprocket means overlying said shelf means and the respective end portions of said horizontally supported topmost workpiece layer, said pair of chains having workpiece layer engaging lugs thereon.

9. The combination according to claim 4 or 8 in which said workpiece layer lifting means and said cam means further includes:

a push lever pivotally supported for vertical pivoting movement by each said triangular frame;

a pusher bar coextensive with the transverse width of said picket bundle secured to the depending end portion of said push levers at the respective ends of said workpiece bundle; and, pusher cam means mounted on said cam shaft and operatively connected with said push levers for simultaneously moving said pusher bars toward and aligning the respective end surfaces of the topmost layer of said workpiece bundle in parallel vertical planes.

10. The combination according to claim 9 and further including:

trigger means supported by said bundle frame and sequentially operated by upward movement of said workpiece bundle for operating said cam means and said pusher bars and aligning the opposing end surfaces of a predetermined number of workpiece layers underlying the topmost layer.

* * * * *